United States Patent [19]

Ciarcia et al.

[11] 4,150,273

[45] Apr. 17, 1979

[54] ENCLOSED CIRCUIT PROTECTIVE DEVICE ASSEMBLY

[75] Inventors: Ronald D. Ciarcia, Bristol; Nilo M. Fachini, Forestville, both of Conn.

[73] Assignee: General Electric Company, New York, N.Y.

[21] Appl. No.: 810,333

[22] Filed: Jun. 27, 1977

[51] Int. Cl.[2] ..... H01H 9/02

[52] U.S. Cl. ..... 200/295; 200/297

[58] Field of Search ..... 200/295, 297, 293, 250

[56] References Cited

U.S. PATENT DOCUMENTS

| | | | |
|---|---|---|---|
| 2,060,603 | 11/1936 | Ball | 200/295 |
| 3,289,049 | 11/1966 | Middendorf | 200/293 |
| 3,383,486 | 5/1968 | Powell | 200/250 |
| 3,463,967 | 8/1969 | Klein | 200/293 |
| 3,562,468 | 2/1971 | Stefani | 200/295 |
| 3,621,173 | 11/1971 | O'Cheskey | 200/295 |

FOREIGN PATENT DOCUMENTS

| | | | |
|---|---|---|---|
| 2428260 | 1/1975 | Fed. Rep. of Germany | 200/293 |
| 545252 | 1/1956 | Italy | 200/293 |

*Primary Examiner*—William Price
*Assistant Examiner*—Joseph M. Moy
*Attorney, Agent, or Firm*—Robert A. Cahill; Walter C. Bernkopf; Philip L. Schlamp

[57] ABSTRACT

A molded case circuit breaker having a raised escutcheon case portion through which its operating handle protrudes and a mounting shoulder at each end is accommodated in an enclosure having a removable frontal cover in which an opening is provided. An elongated sheet metal bracket is slideably mounted within the enclosure and has a hook for engaging one of the breaker mounting shoulders and resilient latch releaseably engaging the other breaker mounting shoulder. The breaker and bracket are slideably positioned as a unit to register the breaker escutcheon case portion with the cover opening for protrusion therethrough in close fitting relation.

5 Claims, 7 Drawing Figures

ENCLOSED CIRCUIT PROTECTIVE DEVICE ASSEMBLY

BACKGROUND OF THE INVENTION

Often times it becomes desirable to supplement an existing electrical wiring installation with an additional branch circuit or to add additional circuit protection to an existing branch circuit. On these occasions it is often impractical and even impossible to physically incorporate the additional circuit protective device, e.g., circuit breaker, within the existing electrical service entry enclosure, i.e., load center. Also, it may be desired to locate the circuit protective device remotely from the service entry enclosure at the site of electrical utilization equipment. To accommodate these situations, small supplemental electrical enclosures are provided suitable for housing the circuit protective device added to an existing branch circuit or installed to afford circuit protection for an additional branch circuit. The supplemental enclosure and circuit protective device may be mounted adjacent to existing service entry equipment or remotely therefrom as desired.

It is a principle object of the present invention to provide an improved enclosed circuit protective device assembly ideally suited for application as a supplement to existing service entry equipment.

A further object is to provide an enclosed circuit protective device assembly of the above-character having an enclosure equipped to accept molded case circuit breakers having differing case configurations.

An additional object of the present invention is to provide an enclosed circuit protective device assembly of the above character which is inexpensive to manufacture and easy to install.

Other objects of the invention will in part be obvious and in part appear hereinafter.

SUMMARY OF THE INVENTION

In accordance with the present invention, there is provided an enclosed circuit protective device assembly having an enclosure consisting of an open-front box having conjoined side and back walls and a cover removably secured in closure relation to the open front of the box. An elongated sheet metal bracket has a body portion in which is provided longitudinally elongated slots through which fasteners extend pursuant to mounting the bracket to the box back wall for sliding movement between first and second longitudinal positions. An upstanding hook is struck from the bracket body adjacent one of the bracket, while a resilient, upstanding latch is struck from the bracket body adjacent its other end. An automatic, molded case circuit breaker is releaseably mounted within the enclosure by the bracket. Specifically, the circuit breaker includes a mounting shoulder adjacent each of its ends, a raised escutcheon case portion through which the breaker operating handle protrudes, and line and load terminals lugs. To mount the circuit breaker, one of its mounting shoulders is engaged by the bracket hook, while the other is releaseably engaged by the bracket latch. The bracket and circuit breaker are then slideably shifted to one of the two bracket positions calculated to register the escutcheon case portion with the opening in the cover when the latter is secured in closure relation with the open front of the box. With the cover in place, the escutcheon case portion protrudes through the cover opening edges to present the circuit breaker handle for convenient digital operation. The bracket latch includes an integral, extended free end portion which ideally serves as a latch release arm. This release arm is oriented in parallel spaced relation to the bracket body and is located so as to be accessible for depression to flex the latch to a mounting shoulder disengaging position, whereby the circuit breaker may be conveniently dismounted from the bracket.

To accommodate plug-in circuit breakers in the assembly of the present invention, there is provided an adapter having an interior stab termination and an electrically interconnected, exterior lug termination. The adapter is affixed to the circuit breaker with its stab termination plugged into the stab jaws of the circuit breaker line terminal. One of the breaker mounting shoulders is provided in the adapter.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Corresponding reference numerals refer to like parts throughout the several views of the drawings.

DETAILED DESCRIPTION

Figure 1:
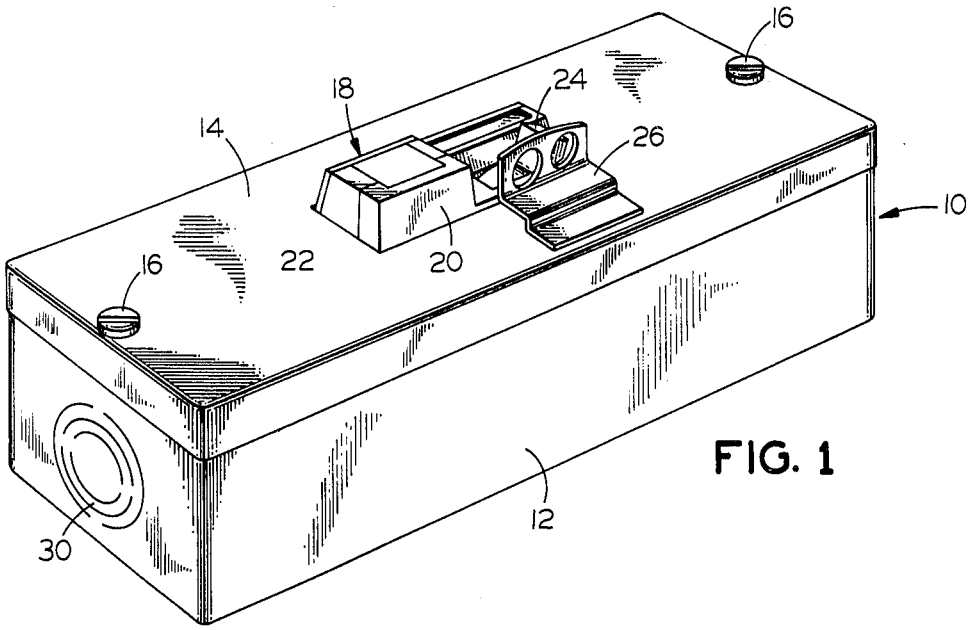
FIG. 1 is a perspective view of the enclosed circuit protective device assembly of the present invention.

The enclosed circuit protective device assembly of the present invention includes, as seen in FIG. 1, an enclosure, generally indicated at 10, consisting of an open-front box 12 and a cover 14 secured to the box by screws 16 in closure relation with the open front thereof. Housed within enclosure 10 is a molded case circuit breaker, generally indicated at 18. The case of circuit breaker 18 is provided with a raised, escutcheon portion 20 which protrudes through a rectangular opening 22 in close fitting relation with the edges of the opening. Protruding through the escutcheon case portion 20 is a pivotally mounted handle 24 which is accessible externally of enclosure 10 for convenient digital manipulation pursuant to operating circuit breaker 18 between its ON and OFF conditions. A flange 26 welded to cover 14 is provided with an outwardly turned free end portion disposed adjacent the breaker operating handle and provided with a pair of circular apertures; either one of which accommodating the hasp of a padlock (not shown) serving to obstruct pivotal movement of the breaker handle pursuant to locking the breaker in either of its ON or OFF conditions, as desired. The end walls of box 12 are provided with knockouts 30 facilitating the creation of holes in the enclosure for the admittance of electrical cable (not shown) for the branch circuit in which circuit breaker 18 is to be installed.

Figure 5:
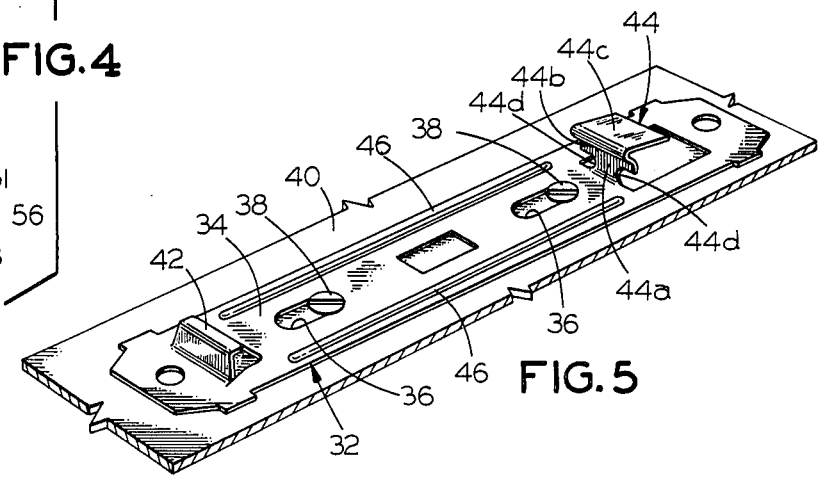
FIG. 5 is a fragmentary perspective view of a mounting bracket for mounting either of the circuit breakers of FIGS. 2 and 3 in the assembly of FIG. 1.
Figure 6:
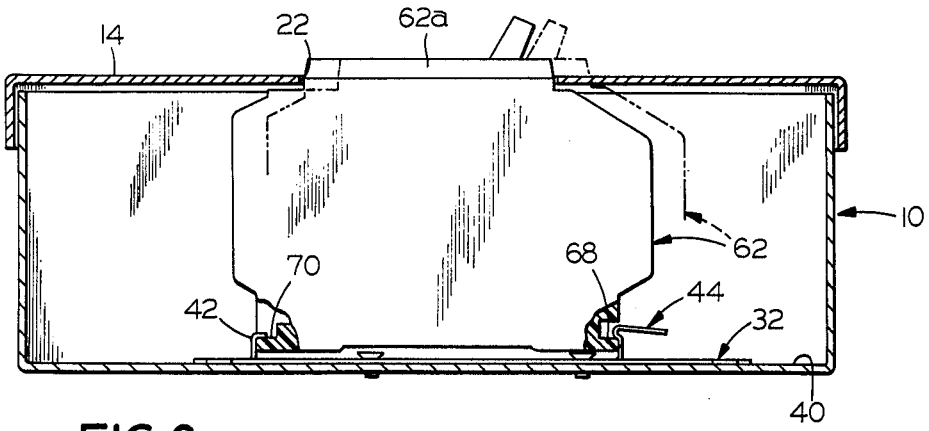
FIG. 6 is a longitudinal sectional view of the assembly of FIG. 1 depicting the proper mounted position for the circuit breaker of FIG. 2.
Figure 7:
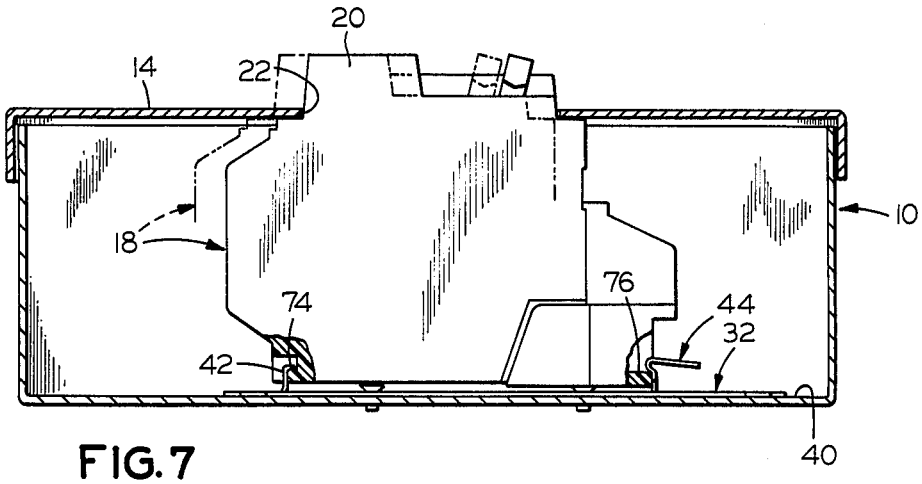
FIG. 7 is a longitudinal sectional view of the assembly of FIG. 1 depicting the proper mounted position for the circuit breaker of FIG. 3.

To mount the circuit breaker within enclosure 10, the assembly of the present invention includes a bracket, generally indicated at 32 in FIGS. 5 through 7. This bracket is preferably fashioned as a sheet metal stamping having an elongated, planar body 34 in which are formed a pair of longitudinally spaced, longitudinally elongated slots 36. Bracket 32 is mounted to the enclosure by a pair of screws 38 which extend through slots 36 and thread into tapped bores formed in the back or bottom wall 40 of enclosure box 12. These screws do not tightly clamp bracket 32 to back wall 40, and thus the bracket is reasonably freely mounted for longitudinal sliding movement within enclosure 10.

Struck from body 34 adjacent one end of bracket 32 is an upstanding hook 42. Adjacent the other end of the bracket a latch, generally indicated at 44, is struck from the bracket body 34. Latch 44 has a configuration consisting of an upstanding leg **44*a* integrally joined at its lower end to bracket body 34 and extending upwardly into a double reverse bend to create an elevated latch nose 44*b* disposed in facing relation with hook 42. The terminal, free end portion of the latch beyond nose 44*b* is in the form of a latch release arm 44*c* which is deployed in substantially parallel, spaced relation to bracket body 34. To provide a reasonable measure of flexibility to latch 44, its leg 44*a* is provided adjacent its junction with bracket body 34 with a pair of opposed lateral undercuts 44*d*. To impart a measure of rigidity to the body of bracket 32, a pair of longitudinally elongated, raised ribs 46** may be stamped in the bracket body.

Figure 3:
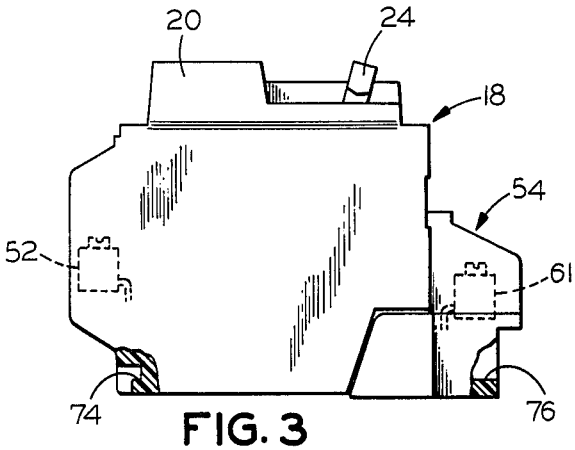
FIG. 3 is a side elevational view, partially broken away, of an alternative style of molded case circuit breaker utilizable in the assembly of FIG. 1.
Figure 4:
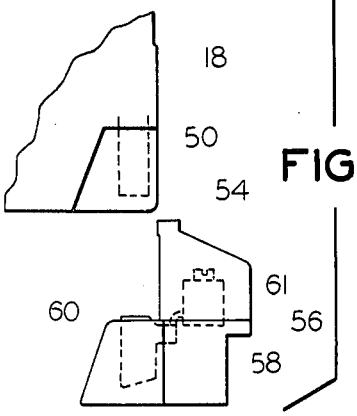
FIG. 4 is a fragmentary, exploded, side elevational view illustrating the adaptation of a stab-to-lug terminal adapter to the plug-in circuit breaker of FIG. 3.

The assembly of the present invention, by virtue of the construction and mounting of bracket 32, is capable of utilizing various types of molded case circuit breakers. The circuit breaker 18 seen in FIG. 1 is illustrated separately in the side elevational view of FIG. 3 as a ground fault circuit breaker, such as a type THQL plug-in GFCI circuit breaker marketed by assignee's Circuit Protective Devices Department, Plainville, Connecticut. This GFCI circuit breaker has substantially the same case configuration as assignee's type TQL plug-in circuit breaker which provides traditional overload and short circuit protection, but not ground fault protection. As best seen in FIG. 4, the type THQL ground fault circuit breaker and the conventional TQL breaker each have an identical stab line terminal termination, illustrated at 50, and a lug load terminal termination, illustrated at 52 in FIG. 3. The stab line terminal terminations of these breakers are ideal for convenient installation of plug-in circuit breaker load centers, but are not appropriate for application in enclosure 10. Rather, this application ideally calls for a circuit breaker having line and load terminal terminations each in the form of lugs to accommodate wire-in, wire-out electrical installation. To convert plug-in breaker 18 to a lug-lug circuit breaker, the assembly of the present invention includes, in one of its embodiments, a stab-to-lug converter to adapter, as generally indicated at 54 in FIGS. 3 and 4. This adapter includes a molded, insulative body 56 structured to mount a generally S-shaped conductive strap 58 terminating at its lower end in a stab blade 60 and at its upper end in electrical connection with a lug 61. Adapter 54 is adapted to circuit breaker 18 with stab blade 60 plugged into the resilient jaws of the circuit breaker stab line terminal termination 50. The adapter may be secured in place by any suitable means, such as cement, to convert circuit breaker 18 from a plug-in type breaker to a lug-lug breaker appropriate for utilization in the assembly of the present invention.

Figure 2:
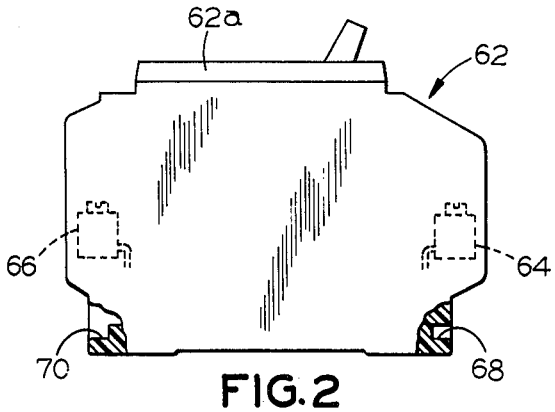
FIG. 2 is a side elevational view, partially broken away, of one style of molded case circuit breaker utilizable in the assembly of FIG. 1.

Equally utilizable in the assembly of the present invention is a lug-lug circuit breaker, illustrated generally at 62 in FIG. 2 as assignee's type TQC circuit breaker having a lug line terminal termination 64 and a lug load terminal termination 66. Since this circuit breaker comes equipped for wire-in, wire-out installation, utilization in the assembly of the present invention does not require any conversion through the utilization adapter 54.

Referring to FIG. 6, to facilitate the mounting of circuit breaker 62 within enclosure 10, the lower corner of the breaker case beneath line terminal 64 is recessed to provide a mounting shoulder 68. Similarly, the other lower corner of the breaker case is recessed beneath load terminal lug 66 to provide a second mounting shoulder 70. In mounting circuit breaker 62 to bracket 32, hook 42 is engaged on mounting shoulder 70 and the breaker is then swung inwardly toward engagement with latch 44. The latch is deflected as latching nose **44*b* rides over the corner of the breaker case and snaps back into engagement with mounting shoulder 68, thereby effecting the mounting of circuit breaker 62 to bracket 32 and thence to enclosure 10 as seen in FIG. 6. Should it be desired to dismount circuit breaker 62, a suitable tool such as a screw driver is used to depress release arm 44*c*, thereby deflecting latch 44 to swing latching nose 44*b* away from engagement with mounting shoulder 68. The line terminal end of the circuit breaker is then swung away from bracket 32 incident to disengaging hook 42 from mounting shoulder 70**.

The lug-lug converted circuit breaker 18 is mounted to bracket 32 in the same manner as circuit breaker 62. Thus, the lower corner of circuit breaker 18 beneath load terminal lug 52 is recessed to provide a mounting shoulder 74, while the lower corner of adapter 54 beneath adapter lug 61 is recessed to provide a second mounting shoulder 76. As seen in FIG. 7, hook 42 engages mounting shoulder 74, while latch 44 engages mounting shoulder 76, pursuant to releaseably mounting circuit breaker 18 to bracket 32 and thence to enclosure 10.

Since different types of circuit breakers typically have different case configurations, which is true for circuit breakers 18 and 62 illustrated herein, a problem is encountered in correlating the mounting location of a circuit breaker within enclosure 10 with the location of opening 22 in cover 14 such that the raised escutcheon portion of the breaker case can protrude therethrough. In accordance with the present invention, this problem is resolved by slideably mounting bracket 32 to back wall 40 of box 12 in the manner previously described. This mounting feature permits the mounting location of the circuit breaker within enclosure 10 to be appropriately shifted so as to register the raised escutcheon portion of the breaker case with cover opening 22 when the cover is secure in closure relation to the open front of box 12. Referring to FIG. 6, it is seen that with circuit breaker 62 mounted to bracket 32 with the latter in its rightmost position, it is seen from the phantom line position of circuit breaker 62 that its raised escutcheon case portion 62*a* is not in registry with cover opening 22. As a consequence, the circuit breaker interferes with the proper application of cover 14 to box 12. However, when the circuit breaker and bracket are shifted leftward to the bracket's leftmost position, it is seen that the escutcheon case portion 62*a* now registers with the cover opening 22 when the cover is applied to box 12.

Referring now to FIG. 7, it is seen that if circuit breaker 18 is mounted to bracket 32 while the latter is in its leftmost position, escutcheon case portion 20 of circuit breaker 18 does not register with cover opening 22. It only remains to shift the circuit breaker and bracket as a unit rightward in order to register the escutcheon case portion 20 with cover opening 22 and then the cover can be secured in closure relation with the open front of box 12.

From the foregoing, it is seen that an enclosure, or at least the cover thereof, may be of a single design and yet be capable of accommodating circuit breakers of different case configurations. Inventory and manufacturing costs are thus reduced.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. An enclosed circuit protective device assembly comprising, in combination:

A. a molded case circuit breaker having line and load terminal lugs, first and second mounting shoulders provided in recessed portions of the breaker case, and a raised escutcheon case portion through which an operating handle protrudes, B. an enclosure including (1) an open-front box having conjoined side and back walls, (2) a cover removably secured to said box in closure relation to the open front thereof, and (3) means forming an opening in said cover;

C. an elongated sheet metal bracket having (1) a pair of longitudinally elongated openings in said bracket for receipt of fasteners pursuant to mounting said bracket to said back wall for limited, sliding, longitudinal movement between first and second positions, (2) an upstanding hook struck from the body of said bracket adjacent its one end for protrusion into one of the case recessed portions to engage said first breaker mounting shoulder and, (3) an upstanding resilient latch struck from the body of said bracket adjacent its other end, said latch protruding into another of the case recessed portions to releaseably engage said second breaker mounting shoulder pursuant to mounting said circuit breaker in said box, (4) whereby said circuit breaker and bracket are selectively slideably positioned as a unit to one of said first and second bracket positions pursuant to registering said raised escutcheon case portion with said cover opening such that said escutcheon case portion protrudes freely through said opening in close fitting relation with the edges thereof when said cover is secured in closure relation to the open front of said box.

2. The assembly defined in claim 1, wherein said latch includes a free end extension serving as a latch release arm, said arm disposed in parallel spaced relation to the body of said bracket, and being manually depressible to disengage said latch from said second breaker mounting shoulder.

3. The assembly defined in claim 1, wherein said circuit breaker is of a plug-in type having a stab line terminal termination, said assembly further including a stab-to-lug adapter secured to said breaker and electrically connected to said breaker stab line terminal termination.

4. The assembly defined in claim 3, wherein one of said breaker mounting shoulders is provided in said adapter.

5. The assembly defined in claim 4, wherein said latch includes a free end extension serving as a latch release arm, said arm disposed in parallel spaced relation to the body of said bracket, and being manually depressible to disengage said latch from said second breaker mounting shoulder.

* * * * *